United States Patent [19]

Hinrichs

[11] 4,233,739

[45] Nov. 18, 1980

[54] CHAINSAW ACCESSORY

[76] Inventor: Leslie W. Hinrichs, Box 176, Summerland, Calif. 93067

[21] Appl. No.: 57,791

[22] Filed: Jul. 16, 1979

[51] Int. Cl.[3] ..... B27B 17/00

[52] U.S. Cl. ..... 30/383

[58] Field of Search ..... 30/381, 382, 383, 371, 30/293; 33/185 R

[56] References Cited

U.S. PATENT DOCUMENTS

| | | | |
|---|---|---|---|
| 2,807,292 | 9/1957 | Gelinas | 30/383 |
| 3,364,580 | 1/1968 | Lucia | 30/383 X |
| 4,185,382 | 1/1980 | Rawlinson | 30/383 |

*Primary Examiner*—Jimmy C. Peters

*Attorney, Agent, or Firm*—Ralph B. Pastoriza

[57] ABSTRACT

An accessory device is provided for securement to a conventional portable type chainsaw to define a fixed predetermined distance of the cutting plane of the saw from an end of a work to be cut. With this arrangement, successive cuts of identical lengths can be rapidly made. The accessory itself comprises a plurality of straight cylindrical tubes nested in telescoping relationship and with appropriate frictional engagement with each other. With this arrangement, any desired length can be defined by the extent of telescoping of the tubes and the defined lengths remain fixed as a consequence of the friction between the tubes. This fixed length can thus be used for successively measuring off equal cuts of a log or other wood to be cut by the chainsaw and the operator need not be concerned with further adjustments until such time as the successive cuts are to be changed in length.

2 Claims, 3 Drawing Figures

CHAINSAW ACCESSORY

This invention relates generally to woodworking equipment and more particularly to a chainsaw accessory for use in cutting felled trees.

BACKGROUND OF THE INVENTION

It is generally known to attach a measuring device to a chainsaw in order to facilitate cutting successively equal lengths of wood as when chopping up a felled tree. Examples of such arrangements are shown in U.S. Pat. Nos. 2,765,007; 2,807,292; 3,276,490; and 3,364,580. Some of these structures include zig-zag type folding measuring sticks which can be expanded outwardly from the chainsaw. The problem with these devices, however, is that unless the cut to be made is a precise integral number of feet or units corresponding to the lengths of each coupled link of the measuring device, the extending end of the device will over-extend beyond the cut to be used as a reference point in performing the next cut. Thus, the user must examine any inch marks or other measurement marks on the measure itself.

In order to resolve the foregoing problem, it has been proposed to provide a tape-like measure which can be pulled out to any desired distance and locked in such position. However, in order that the tape can be coiled up neatly when not in use it has to be relatively thin and for an extended length of tape, the same is not always self-supporting.

Still other solutions have involved simply attaching a fixed length member to the chainsaw which will define a fixed given length for successive cuts to be made. This arrangement would be satisfactory if all wood was to be cut to a given uniform length. However, it may be desirable to provide a number of cuts which, while identical to each other, are different from some other total number of cuts.

In an attempt to provide a collapsible and extendable member, in addition to zig-zag measuring devices, it has ben proposed to utilize telescoping tapered tubes corresponding to fishing rod like constructions. These tubes will work satisfactorily in that they can be extended to a given distance and then easily retracted and in the extended position, they will hold up under their own weight. The problem, however, is that intermediate fixed distances cannot be set by such devices wherein the tapered telescoping tubes simply will not be locked together in a desired intermediate extended position but only locked frictionally when fully extended.

BRIEF DESCRIPTION OF THE PRESENT INVENTION

With all of the foregoing considerations in mind, the present invention contemplates a greatly improved chainsaw accessory capable of defining a given fixed distance of any desired length within reasonable limits wherein the accessory itself can readily be collapsed when not in use so as to be out of the way and yet when extended to any desired fixed position will remain frictionally in such position without buckling or otherwise collapsing inadvertently.

More particularly, in accord with this invention, the chainsaw accessory comprises a plurality of straight cylindrical tubes of progressively decreasing diameter so that they can be nested in telescoped relationship, the outermost tube being secured to the chainsaw in position such that the telescoped tubes can be extended in a direction normal to this plane. The outer end opening of each tube from which the next successive tube extends is peened radially inwardly so that the outer wall of such next successive tube is frictionally engaged over 360° in a continuous manner regardless of the telescoped position of this next tube. In addition, the inner end opening of each tube surrounded by the next larger tube is flared outwardly to frictionally engage over 360° the inner wall of this larger tube.

With the foregoing arrangement, the telescoped members will remain in any desired set position so that once a given distance is defined by the telescoping tubes, it will permit rapid successive cuts to be made by the chainsaw, all of identical lengths corresponding to the given distance, the end of the telescoping tubes corresponding with the end of each cut.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
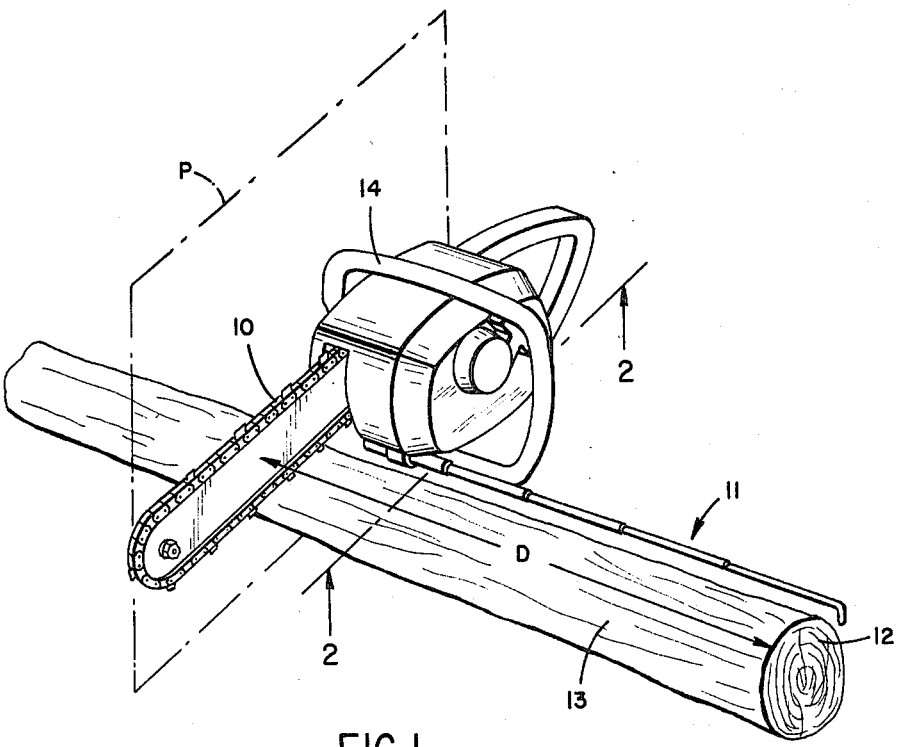
FIG. 1 is a perspective view illustrating the chainsaw and chainsaw accessory of this invention in operation.

Referring first to FIG. 1, there is shown a portable chainsaw 10 provided with an accessory device indicated generally by the numeral 11. This accessory defines in combination with a chainsaw a fixed predetermined distance D between the cutting plane P of the saw and one end 12 of a work to be cut, such as a log 13. With the end of the accessory member 11 coinciding with the cut end 12, successive cuts can then be effected by the chainsaw 10 all of precisely the same length corresponding to the predetermined distance D.

It will be noted from the foregoing that such successive cuts can be made without the operator having to read any measuring numerals or the like. Rather, the operator need only be assured that the end of the extending accessory 11 coincide with the previously cut end of the work.

Figure 2:
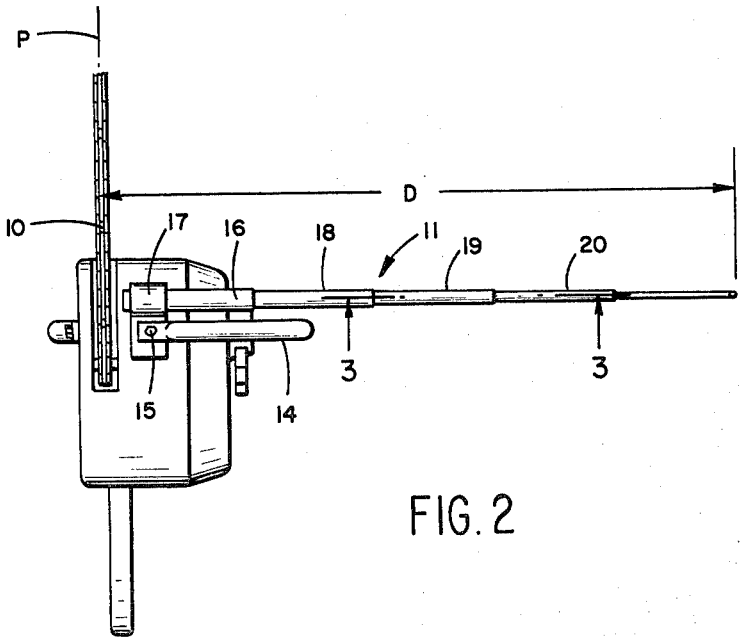
FIG. 2 is an underside plan view looking generally in the direction of the arrow 2—2 of FIG. 1; and, FIG. 3 is a greatly enlarged fragmentary cross section of the accessory taken in the direction of the arrows 3—3 of FIG. 2.

Referring now to the underside of the chainsaw and accessory illustrated in FIG. 2, it will be noted that the chainsaw itself includes a tubular handle 14. The end portions of the tubular handle 14 are normally secured to the body of the saw as by bolts. One such bolt is illustrated at 15 in FIG. 2.

As will be evident from FIG. 2, the accessory device 11 comprises a plurality of straight cylinder tubes of decreasing diameters so that they can be nested in telescoped relationship. The outermost tube is indicated at 16 in FIG. 2 and is secured to the body of the chainsaw 10 by a cooperating anchor plate 17 and the bolt 15 for the tubular handle 14. The securing arrangement permits removal of the accessory device if desired by simply removing the bolt 15.

Various successively extending tubular members making up the accessory 11 are indicated at 18, 19 and 20 in FIG. 2. It is to be noted that the positioning of the outermost tube 16 in its securement to the body of the chainsaw is such that the cylindrical tubular members telescopically extend in a direction normal to the plane P of the chainsaw.

Figure 3:
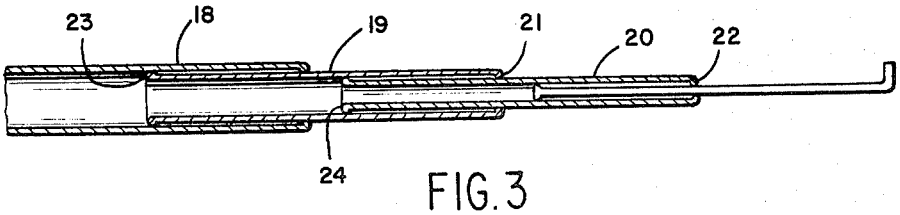

The manner in which the various telescoping tubes can be extended any desired distance and retained in such extended positions will now be evident by referring to the fragmentary cross section of FIG. 3.

As shown in FIG. 3, the outer end opening of each tube from which the next successive tube extends is peened radially inwardly such as indicated at 21 and 22 for the cylindrical tubes 19 and 20. The peening inwardly is such that the outer wall of the next successive tube is frictionally engaged over 360° for any telescoped position.

The inner end opening of each tube surrounded by the next larger tube is, in turn, flared outwardly such as indicated at 23 and 24 for the cylindrical tubes 19 and 20 respectively. The outward flaring is such as to cause a frictional engagement over 360° of the inner wall of the next larger surrounding tube.

The foregoing frictional engagements assure that any lengths to which the tubes are extended will be maintained by such frictional engagement so that the heretofore referred to fixed predetermined distance D can be changed to a different prefixed distance and the tubes retained in such positions to maintain the new distance consistently as the chainsaw is being used.

When it is not desired to use the accessory, all of the telescoping tubes can simply be telescoped inwardly to a collapsed state neatly beneath the body of the chainsaw.

The unique telescoping arrangement in combination with the chainsaw assures a sufficient extension to be possible without any undue sagging or bulking of the extended members. Also, an infinite number of positions can be achieved between the maximum extended position and the completely collapsed position because of the frictional engagement.

It will be seen from all of the foregoing, that the present invention thus provides certain advantages not available in prior art devices heretofore proposed.

In operation, it will be understood that a worker will simply set the telescoped members at a desired predetermined distance. The worker himself can use a conventional tape measure for the initial setting so that the proper predetermined distance, once set, need not again be measured.

Successive lengths of a log of a felled tree can thus be cut each length being precisely the same and corresponding to the set predetermined distance.

If a new predetermined distance is to be utilized defining the lengths of wood to be cut, a resetting is readily accomplished by telescoping the tubes inwardly or outwardly as required. Again, as mentioned theretofore, the set position will always be maintained because of the frictional engagement between the cylindrical tube ends.

I claim:

1. A chainsaw accessory for use in combination with a portable chain saw to define a fixed pre-determined distance of the cutting plane of said saw from an end of work to be cut so that successive cuts of identical lengths can be rapidly made, said accessory comprising a plurality of straight cylindrical tubes of progressively decreasing diameter so that they can be nested in telescoped relationship, the outermost tube being secured to said chain saw in a position such that the telescoped tubes can be extended in a direction normal to said plane, the outer opening end of each tube from which the next successive tube extends being peened radially inwardly so that the outer end of said next successive tube is frictionally engaged over 360°, the inner end opening of each tube surrounded by the next larger tube being flared outwardly to frictionally engage over 360° the inner wall of said larger tube, whereby any length to which the tubes are extended will be maintained by said frictional engagement of the tubes so that said fixed predetermined distance can be changed and retained in the changed position.

2. A chainsaw accessory according to claim 1, in which said chainsaw has a tubular handle with end portions of the tubular handle being secured by bolts to the body of the saw, and in which securement of said outermost tube of said accessory to said chain saw is effected by the same bolt used to secure one end of said tubular handle.

* * * * *